United States Patent [19]

Harris

[11] Patent Number: 4,811,432

[45] Date of Patent: Mar. 14, 1989

[54] FLUSH TANK WATER SAVER

[76] Inventor: John L. Harris, 470 Palm Island, NE., Clearwater, Fla. 34630

[21] Appl. No.: 67,494

[22] Filed: Jun. 29, 1987

[51] Int. Cl.[4] ..... E03D 1/14

[52] U.S. Cl. ..... 4/325; 4/384; 4/393; 4/387; 4/415

[58] Field of Search ..... 4/324, 325, 381–384, 4/391–397, 387, 405–415

[56] References Cited

U.S. PATENT DOCUMENTS

| | | | |
|---|---|---|---|
| 823,832 | 11/1906 | Wayman | 4/381 |
| 2,526,294 | 10/1950 | Stegeman | 4/325 |
| 3,026,536 | 3/1964 | Wood | 4/57 |
| 4,017,912 | 4/1977 | Young, Sr. | 4/324 |
| 4,032,997 | 7/1977 | Phripp et al. | 4/52 |
| 4,135,261 | 1/1979 | Overbey | 4/325 |
| 4,216,555 | 8/1980 | Detjen | 4/325 |
| 4,483,024 | 11/1984 | Troeh | 4/324 |

*Primary Examiner*—Henry J. Recla
*Assistant Examiner*—Linda J. Sholl

[57] ABSTRACT

A flush tank water saver has an elongated semi-circular base fitting around and clamped to the overflow pipe. This base carries an operating lever on pivots close to the flapper valve pivots. One part of this lever engages the flapper valve at its center and pushes it closed. The force causing closure is provided by another part of the lever which extends beneath and generally parallel with a float lever, the two levers being connected by an adjustable chain. The second part of the operating lever is subtantially longer than the flapper valve engaging part giving a mechanical advantage to the float and causing gravity to close the valve. A positive cut off point is provided by a latch holding the operator in open position, this latch being released by the float lever.

A second embodiment utilizes a spring for pushing the valve operator. Movement of the flush lever to flush latches the valve operator open. The latch is released by the float lever.

Both embodiments utilize a stop for the float lever to provide a full flush.

19 Claims, 3 Drawing Sheets

FLUSH TANK WATER SAVER

BACKGROUND OF THE INVENTION

This invention relates to toilet tank controls for selectively providing a water saving short flush or a full flush.

It has long been recognized that toilet flush tanks are one of the worst water wasters in existence. They are flushed often and each time use a full tankful, even through less than half would give an adequate flush for most uses.

Many attempts have been made to develop suitable devices giving the user a choice between a short flush or a full flush. To date, in spite of the demand for water saving, none is on the market. In these devices an extra float is used for pushing the tank flush valve closed before the tank is empty. In the older patents, the float pushes a ball valve straight down. In the newer patents, the float moves straight down and pushes at an angle on the back of the new type pivoted float-flapper valve. These flapper valves are made of a very soft and flexible rubber. Pushing at an angle involves considerable friction loss and the inherent "wobble" of the soft rubber, plus rubbing over trademark raised characters on the flapper valve gives inconsistent results.

The invention disclosed is my application Ser. No. 07/030,080 filed Mar. 26, 1987 now pending overcomes this "wobble" effect of the soft rubber valve with an operator extending across the back of the flapper valve when open. This operator is pivoted so as to push the valve in the same direction it is going, eliminating friction.

SUMMARY OF THE INVENTION

The present invention utilizes the same type of valve operator disclosed in my prior application. The improvement is the provision of a simplified, less expensive and more accurate actuating mechanism for the valve operator.

In one form, the valve operator is attached to an elongated lever giving a pivot having a substantial mechanical advantage in operating the valve. The float applies force at this pivot and the mechanical advantage reduces the size of the float required.

The invention also provides for positive flapper valve closure at a predetermined intermediate water saving level in the tank. The valve operator is restrained from closing the valve by a latch. This latch is released by the float at the predetermined level allowing instant closing of the valve.

In one form of the invention, the float action engages the latch on rising water level and releases the latch on falling water level.

In another form, the latch is engaged by movement of the flush lever to flushing position and is released by the float on falling water level.

BRIEF DESCRIPTION OF THE DRAWING

FIG. 3 is a section taken on line 5—5 of FIG. 1.

DETAILED DESCRIPTION

Figure 1:
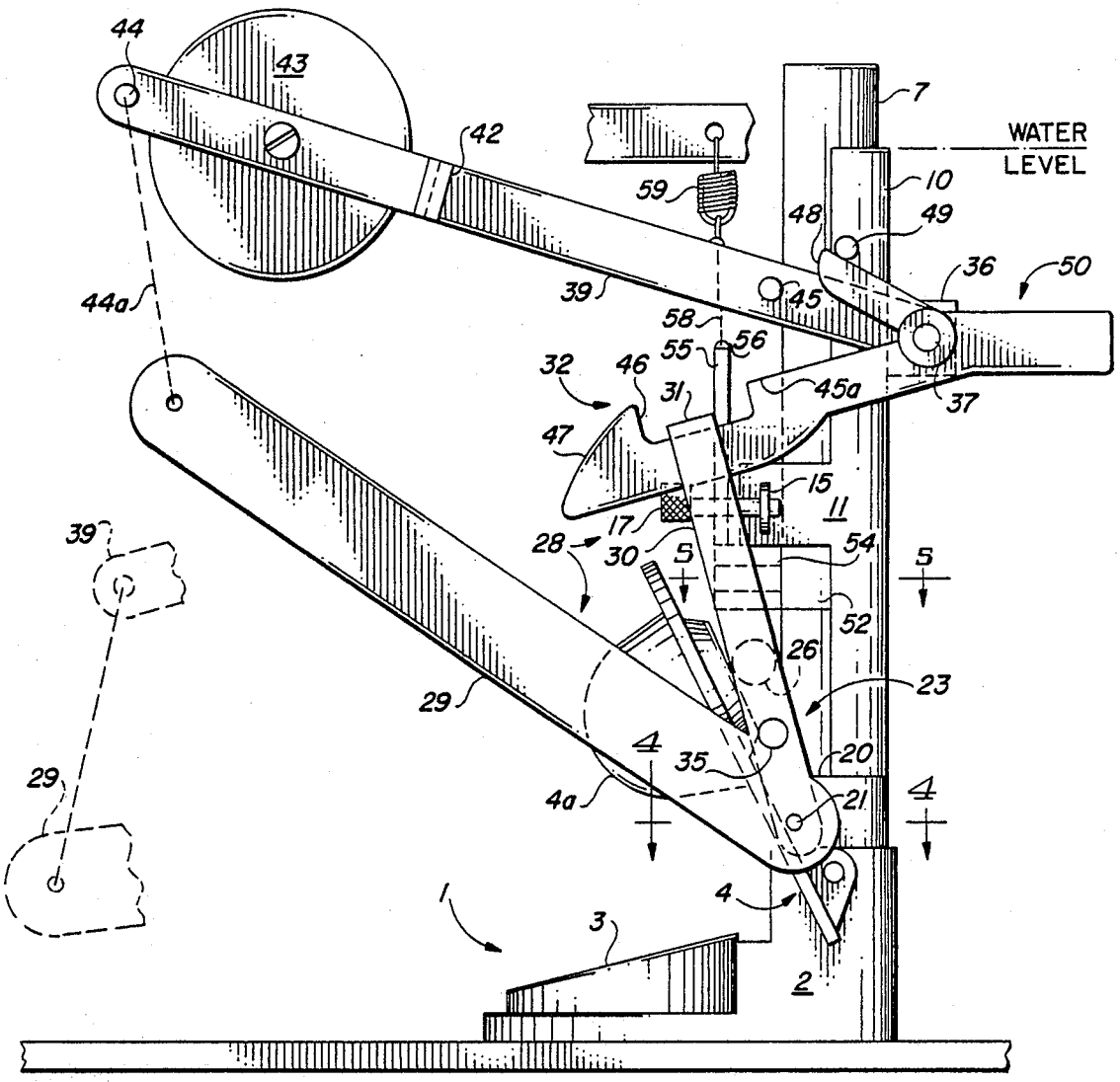
FIG. 1 is a front elevation of one form of the water saver with the parts in the positions assumed at the start of a flush.
Figure 2:
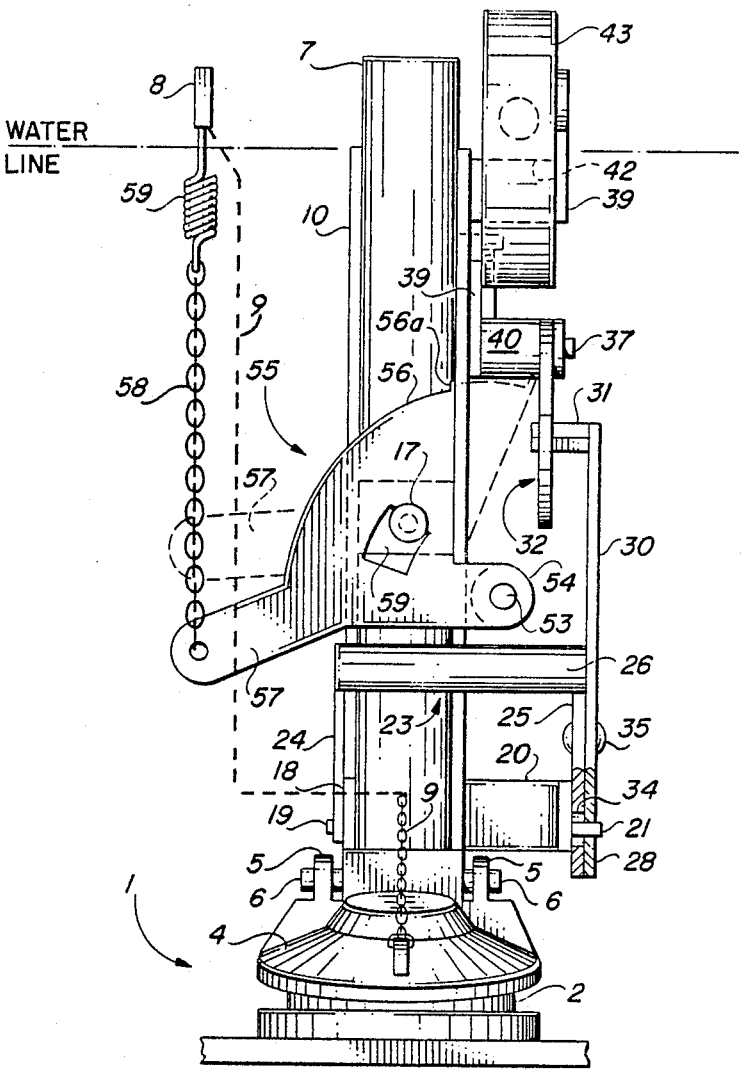
FIG. 2 is an end view of FIG. 1 showing the parts in the positions assumed when the tank is full before a flush.
Figure 6:
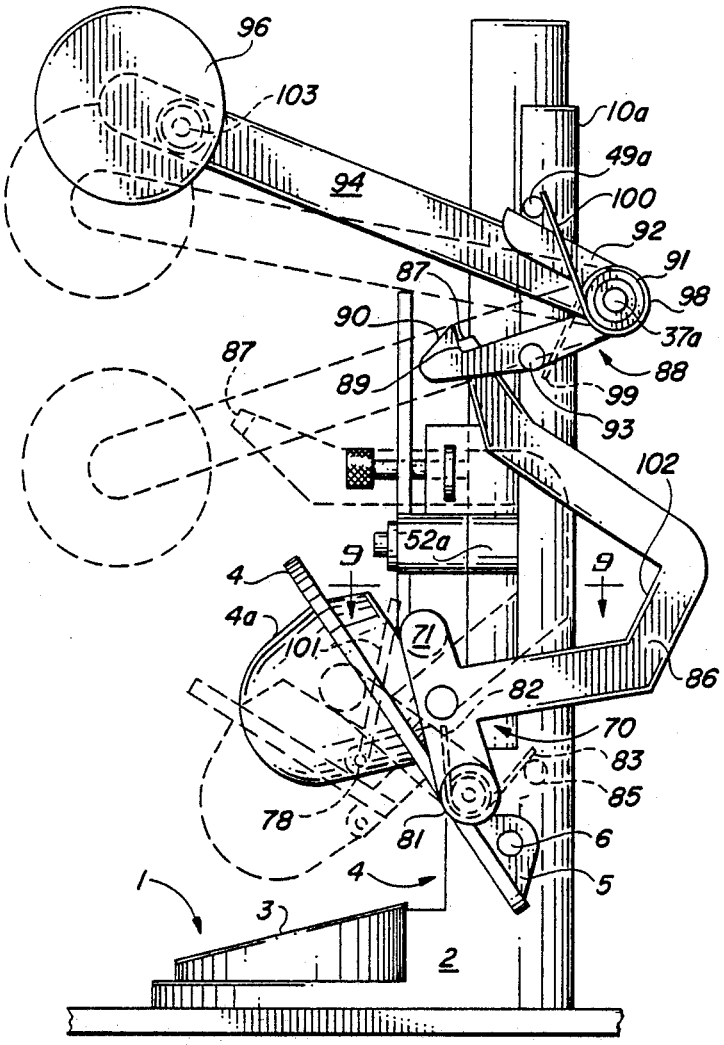
FIG. 6 is a view similar to FIG. 1 of a modification. Parts are in the positions assumed at the start of a flush.

Referring to FIGS. 1 and 2, reference character 1 indicates generally the outlet valve mechanism of a typical modern flush tank. This includes a base or outlet fitting 2 having an outlet valve port 3 normally covered by a float type flapper valve 4. As usual, the flapper valve as shown in FIG. 6 is provided with ears 5 on both sides of the base 2 pivotally mounted to supports 6 formed on the base. Extending upwardly from the base 2 is an overflow pipe 7 extending above the water level as indicated. The flapper valve 4 is operated by in the usual manner, by a flush lever 8 (FIGS. 2 and 3) which is connected to the valve by a chain 9. When the flush lever is moved upward by an external flush lever (not shown) it pulls the flapper valve 4 from its seat and the float portion 4a causes it to move to the wide open position of FIG. 1. When the water level drops below float 4*a*, the flapper valve rotates about its pivot and falls into its closed position of FIG. 2. The arrangement described so far is standard equipment in typical flush tanks.

Figure 3:
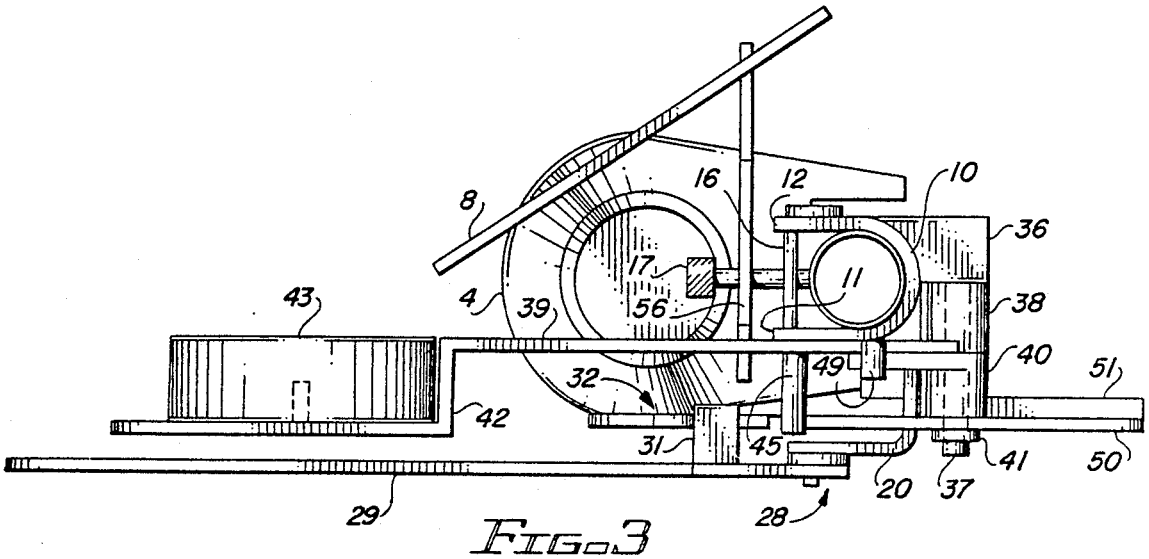
FIG. 3 is a top view of FIG. 1 showing the installation in a typical flush tank.

The invention to be described is an attachment that may be easily installed in existing flush tanks. This attachment includes an elongated molded plastic semicircular base 10 fitting around the right side of overflow pipe 7 as seen in FIGS. 1 and 3. Near the middle are two extensions from the semi-circle 11 and 12 (FIG. 3). These extensions have slots as at 15 which support a mounting clamp 16 carrying a knurled set screw 17. This set screw firmly holds the semi-circle base 10 against the overflow tube 7.

Figure 4:
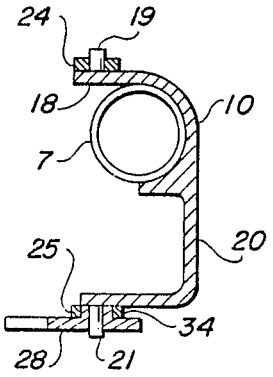
FIG. 4 is a section taken on line 4—4 of FIG. 1.

The lower end of the semi-circular base 10 adjacent fitting 2 is formed with a forward extension 18 having a pivot stud 19, in proximity of the flapper valve pivots 5 (FIGS. 2 and 4). It is also formed with an extension 20 extending to the right as seen in FIG. 2 and then forwardly parallel with extension 18 and carrying a pivot stud 21. Pivotally mounted on studs 19 and 21 is a flapper valve operator generally indicated as 23. This operator includes upwardly extending legs 24 and 25 fitting over studs 19 and 21 and carrying a crossmember 26 extending behind flapper valve 4 as seen in FIG. 1.

Attached to valve operator 23 is a "V" shaped lever 28 having an operating leg 29 and a latching leg 30. Leg 29 when the tank is full extends upwardly to the left as seen in FIG. 1. Latching leg 30 extends generally upwardly and includes a latching section 31 extending inwardly into the path of latch 32. Lever 28 is preferably formed with a hub 34 fitting over pivot pin 21 and carrying leg 25 of valve operator 23 (FIGS. 2 and 4) The two parts are held together by a rivet.

Formed on the rear of semi-circular base 10 at its upper end is a boss 36 (FIG. 3) which extends to the center of base 10. This boss carries an elongated pivot 37 supporting a hub 38 for float lever 39 and a hub 40 for latch 32, these hubs being held in place by retainer 41. The float lever extends beyond the float and is formed with a chain attaching hole 44 for an adjustable chain 44*a* attached to valve operating lever 29. Float lever 39 si also formed with an operator pin 45 extending over latch 32 as shown in FIG. 3.

The latch 32 has three sections. The latching section extendins to the left and includes a latching surface 46 in the path of latching section 31 on leg 30 of lever 28. It also includes a camming surface 47. A stop section of the latch includes a stop lever 48 extending from the inner end of hub 40 into engagement with a stop pin 49 formed on base 10. A weight section 32 to the position of hub 40 and carries a weight 51. This biases the latch 32 to the position shown in which stop lever 48 engages pin 49.

Figure 5:
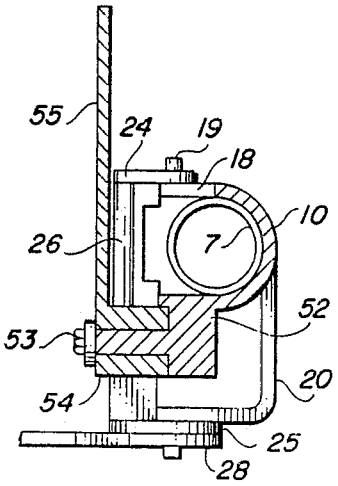

Immediately below mounting extension 11 on base 10 is a forwardly and outwardly extending boss 52 having a pivot pin 53 (FIG. 5) supporting hub 54 of a float stop lever 55. This lever has a stopping surface 56 moveable into position under the float lever 39 when the stop lever is rotated clockwise from the position shown in FIG. 2 to the dotted line position. It is so moved by a lever extension 57 connected by a chain linkage 58 to the flush lever 8. When the flush lever is moved up to a start a flush, the stop surface 56 moves under the float lever 39. Movement of stop lever 55 is limited by edges of slot 59 in this lever engaging the mounting screw 17. If desired, the linkage 58 may include a tension spring 59 for strain relief.

In installation the user first places base 10 an overflow pipe 7, pushes it down all the way against fitting 2, points set screw 17 at the center of the flapper valve 4 and tightens it. Chain 58 is then attached to flush lever 8 with a little slack, allowing stop lever 55 to be in its bottom or inactive position. The last step is to adjust the inlet valve float to cause the full water level to be even with the top of base 10, as shown.

OPERATION OF FIGS. 1-5

The latch or restraining means 32 improved repeat accuracy of the water saver. However, the device is operable without this latch. This operation will first be described. FIG. 2 shows the parts when the tank is full. The flapper valve 4 is closed and the float 43 is at its top position. As shown in FIG. 1, float arm 39 has lifted valve lever 29 to move the flapper valve bar 26 to a position allowing full open movement of the flapper valve.

When a water saving flush is desired, the user depresses the external flush lever and immediately releases it. This pulls the valve open and rotates stop lever 55 to bring surface 56 under float lever 39. Due to the immediate release of the flush lever, stop lever 55 returns to its normal position and allows the float lever to pass as the water level drops. lever 23 rotates counterclockwise about its pivot 21, and crossbar 26 moves to the left, pushing the flapper valve toward closed position. This increases the effective area of the top of the flapper valve that is exposed to the down rushing water.

When the water level is about half way down a critical point is reached where the downward force on the top of the flapper valve overcomes its buoyancy. The flapper valve how snaps to its closed position providing a short flush.

It should be noted that the distance along lever 29 from its pivot 21 to float chain **44*a* is substantially greater than the distance from pivot 21 to the valve operator crossbar 26. This gives a substantial mechanical advantage to the float in operating the flapper valve, allowing it to be smaller. The weight of lever 29** alone is sufficient to push the flapper valve to closed position. Then when the float drops with water level, it allows the weight of the lever to actuate the flapper valve.

As pointed out in my copening application Ser. No. 07/030,080 filed Mar. 26, 1987, the arrangement of the valve operator lever pivots in proximity to the flapper valve pivots causes the point of contact between the valve and operator to travel in substantially the same direction. This reduces friction loss, allows use of less mechanical advantage from the lever and provides more consistent results.

When a full flush is desired, the user holds the external flush lever down about 1½ seconds. This holds the stop lever 55 in stopping position long enough for stopping surface 56 to be engaged by the bottom of float lever 39, stopping the float. This renders the water saver inoperative and a full flush occurs. A small projection **56*a* at the end of the stopping surface 56** insures that the stopping lever remains in stopping position after the flush lever is released.

The water level at which the valve closes may be varied by adjusting the effective length of chain **44*a***. Lengthening this chain advances the closure of the flapper valve, causing the flush to stop at a higher water level.

OPERATION WITH LATCH

With the parts in the positions shown, the latch 32 is in latching position where stop arm 48 engages stop pin 49 on base 10. The latching section 31 on lever 23 is behind latching surface 46 on the latch.

When a short flush is desired, the external flush lever is depressed and immediately released. The float drops with water level. However, movement of lever 23 is stopped by engagement of latching section 31 with latch surface 46 insuring the flapper valve remains open. As the float drops with water level, its pin 45 engages top section **45*a* of the latch causing the latch to move downward, surface 46 sliding on latching section 31. At the flush cut-off point, surface 46 disengages section 31 and the weight of lever leg 29 rotates lever 23** to close the flapper valve.

In latch models the length of chain **44*a* is preferably fixed at a length insuring the flapper valve will be closed when the latch is released. After closure of the flapper valve, the tank refills, float 43 rises and pulls up lever leg 29. Latching section 31 engages camming surface 47** on the latch pushing it down, allowing movement back to the latched position shown.

FIGS. 6-9

This embodiment of the invention omits the long lever 29 of FIG. 1 for applying force by gravity for closing the flapper valve.

Figure 7:
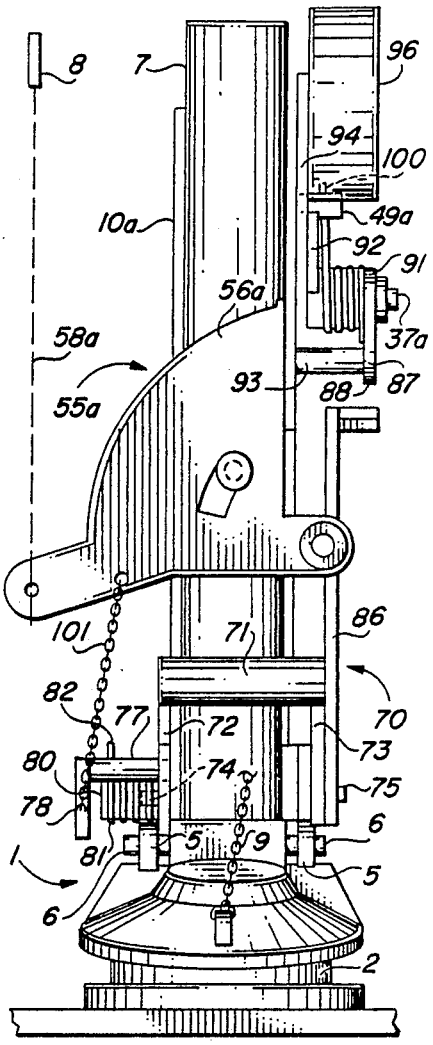
FIG. 7 is an end view of FIG. 6, but showing the parts when the tank is full before a flush.
Figure 8:
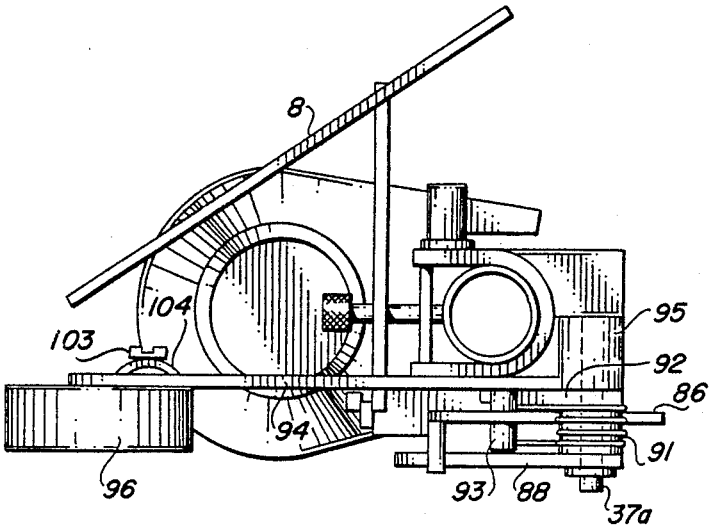
FIG. 8 is a top view of FIG. 7.
Figure 9:
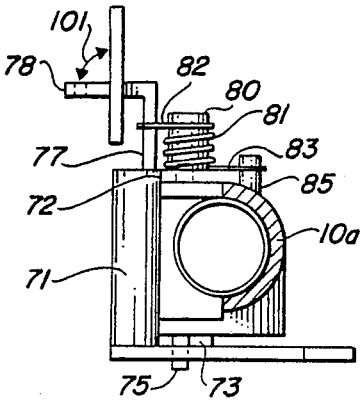
FIG. 9 is a section taken on line 9—9 of FIG. 6.

The valve operator 70 is formed similarly to valve operator 23 but, is not as wide as shown in FIG. 7. The extra width of operator 23 in FIG. 2 is to cause lever leg 29 to clear the flapper valve. Valve operator 70 includes a crossbar 71 behind the flapper valve and two downwardly extending legs 72 and 73 fitting over pivot pins 74 and 75. Formed on leg 72 is an extension 77 extending to the left as seen in FIG. 7 and merging with a forward extension 78. Also formed on leg 72 over pivot pin 74 is a spring hub 80 carrying a torsion spring 81 having outwardly extending ends 82 and 83. End 82 bears against the back of extension 77 and end 83 bears against a pin 85 formed on base **10*a*. This arrangement provides force urging the valve lever 70 counter clockwise for pushing flapper valve 4** closed.

Attached to valve operator 73 is a latching lever 86. This lever extends rearwardly around the back of stop lever boss 52*a* and upwardly, terminating in an outwardly extending latching section 87 engaging a latch 88 carried by pivot pin 37*a*. Latch 88 similar to latch 32 of the first embodiment, including a latching surface 89, a camming surface 90, a hub 91 and a stop lever 92 engaging stop pin 49*a* on base 10*a*. Latch 88 also includes rearwardly extending pin 93 extending into the path of float lever 94. This float lever has a hub 95 also carried by pivot pin 37*a*, and carries a float 96. Latch 88 is biased upwardly into latching position by a torsion spring 98 surrounding hub 91 and having ends 99 and 100. End 99 bears on latch pin 93 and end 100 bears on stop pin 49*a* on base 10*a*.

The float stop lever 55*a* is the same construction as in the first embodiment. A chain 58*a* connects it with flush lever 8. A second chain 101 also connects it with the end of extension 78 of the flapper valve operator.

OPERATION OF FIGS. 6–9

FIG. 7 shows the parts in the positions when the tank is full and before a flush. The flapper valve is closed and the float is at its top position. Also the latch lever 86 and flapper valve operator 70 are in the dotted line positions shown in FIG. 6.

When a short flush is desired, the user pushes on the external flush lever and immediately releases it. Flush lever 8 rises pulling the flapper valve open and raising float stop lever 55*a* into stopping position. The immediate release of the flush lever allows the stop lever to return to inactive position. The operation of stop lever 55*a* pulls on chain 101, which rotates the valve operator 70 to its full line position shown in FIG. 6 allowing the flapper valve to move into wide open position. During this rotation the latching section 87 moves from its unlatched dotted line position to latched position shown in full lines. Latch 88 now holds the flapper valve operator in open position against the force of spring 81.

As the flush proceeds, float 96 follows the water level down. Near the end of the short flush, the bottom edge of float lever 94 engages latch pin 93 and moves the latch down causing latching surface 89 to disengage latching section 87. Operator 70 is now moved with snap action by spring 81 to its dotted line position where flapper valve 4 is caught by the descending water and closed. The tank now refills and the parts assume the positions of FIG. 2. Movement of operator 70 is stopped by portion 102 of latch lever 86 engaging the back of boss 52*a* which supports the float stop lever 56*a*. The operation of this float stop lever is the same as described for FIGS. 1–6.

It should be noted that float 96 is attached to float lever 94 by screw 102 which is eccentrically located on the float. A tension washer 104 under the screw head permits the float to be rotated on the lever. This provides and adjustment for the water saving cut-off level. Rotations of the float clockwise lowers the lever 94 relative to the float, causing the cut-off to occur at a higher water level.

I claim:

1. A water save control for a toilet flush tank having an outlet fitting, an integral float type flapper valve for closing the outlet of said fitting, pivots supported by the outlet fitting supporting the flapper valve and an externally operated flush lever connected to the flapper valve for opening the flapper valve on upward movement of the flush lever to flushing position, the combination of, pivot means supported by the outlet fitting adjacent the pivots for the flapper valve, lever means carried by said pivot means, said lever means having a first portion extending upwardly to the flapper valve when open and arranged to engage the back of the flapper valve to push same to closed position when moved in one direction said lever means also including an elongated portion extending from its pivot means at an angle to the first portion and beside the flapper valve a distance greater than that from the pivot means to the flapper valve engagement providing a point having mechanical advantage, and float mens engaging said point, said float mens being constructed and arranged to cause movement of the lever means in said one direction when the float means lowers with water level.

2. The combination recited in claim 1 in which the elongated section of the lever means is formed with an underwater weight sufficient to move the flapper valve from its open position toward closed position by gravity.

3. A water saver control for a toilet flush tank having an outlet fitting, an integral float type flapper valve, for closing the outlet of said fitting, pivots supported by the outlet fitting supporting said flapper valve, and an externally operated flush lever connected to the flapper valve for opening the flapper valve on upward movement of the flush lever to flushing position, the combination of, pivot means supported by the outlet fitting, lever means carried by said pivot means and engaging the back of the flapper valve when open and arranged to push same toward closed position when moved in one direction, said lever means including an elongated section extending from its pivot means a distance greater than that from the pivot means to the flapper valve engagement, providing a point having mechanical advantage, float means engaging said point, said float means being constructed and arranged to cause movement of the lever means in said one direction when the float means lowers with water level, restraining means for restraining movement of the lever means toward valve closing position to prevent closure of the valve and means operated by the float means at a predetermined water level for releasing said restraining means, allowing the lever means to close the valve.

4. The combination recited in claim 3 including means operated by the float means on rising water level to move the lever means into position to be restrained.

5. In a water saver control for a toilet flush tank having a normal water level, an outlet fitting, an integral float type flapper valve pivotally mounted on the outlet fitting and an externally operated flush lever connected to the flapper valve for opening same on upward movement of the flush lever to the flushing position, the combination of, pivotally mounted flapper valve lever means engaging the back of the flapper valve when open and arranged to push same toward closed position when moved in one direction, said lever means including an elongated section extending from its pivot mount a distance greater than from the pivot mount to the flapper valve engagement providing a point having mechanical advantage, and float means engaging said point, said float means being constructed and arranged to cause movement of said lever means in said one direction when the float means lowers with water level, said float means including a float lever means pivotally mounted near the water level of the flush tank and a linkage between said point on the flapper valve lever means and the float lever means.

6. The combination recited in claim 6 including stop means for preventing closure of the flapper valve, said stop means being arranged to be engaged by one of said lever means when in stopping position and having a neutral position allowing said lat mentioned lever means to pass, means activated by the flush lever on movement to flushing position for moving the stop means to stopping position, and means for maintaining the stop means in stopping position when engaged by said last mentioned lever means.

7. The combination recited in claim 5 in which the linkage is a adjustable chain for varying the water level at which the flapper valve lever means closes the flapper valve.

8. The combination recited in claim 5 including restraining means for restraining movement of the flapper valve lever means toward valve closing position, and means operated by the float lever at a predetermined position for releasing said restraining means.

9. In a water saver control for a flush tank having an outlet fitting, an integral float type flapper valve pivotally mounted on the outlet fitting and externally operated flush lever connected to the flapper valve for opening same on upwardly movement of the flush lever to flushing position, the combination of, operator means arranged to operate the flapper valve, said operator means being biased with sufficient force to move the flapper valve toward closed position restraining means associated with the operator means for holding the latter in a position allowing movement of the flapper valve to open position, means for moving the operator means to restrained position, and float means arranged to release the restraining means when the water level drops to an intermediate water saving level.

10. The combination recited in claim 9 in which the means for causing movement of the operator means into restrained position includes a float responding to rising water level.

11. The combination recited in claim 10 in which the same float moves the operator means to restrained position on rising water level and releases the restraining means on falling water level.

12. The combination recited in claim 9 in which the means for causing movement of the operator means into restrained position is a linkage between the flush lever and operator means.

13. In a water saver control for a flush tank having an outlet fitting, a flapper valve pivotally mounted to close said outlet, and a flush lever connected to the flapper valve for moving it to flushing position, the combination of, closing means including float means and flapper valve operator means for closing the flapper valve at an intermediate water saving level, first holding means for preventing operation of the closing means for a fully cycle to provide a full flush, second holding means including a latch arranged to prevent the valve operator means from closing the flapper valve, means for releasing said latch to permit the valve operator means to close the valve at the intermediate water saving level, and connecting means connected to the flush lever for activating both holding means.

14. The combination recited in claim 13 in which the connecting means includes a first portion connecting one of holding means to the flush lever, and a second portion connecting the two holding means.

15. The combination recited in claim 14 in which the first holding means is connected to the flush lever.

16. In a water save control for a toilet flush tank having an outlet valve and a flush lever connected thereto for moving the valve to flushing position, the combination of, closing means including a float for closing said valve at an intermediate water saving level in the tank, said float being carried by a lever mounted on a pivot, said closing means also including a holding latch arranged to be released by the float at said intermediate water level said latch being arranged to prevent operation of the closing means until released by said float said latch having a pivot near the lever pivot and extending in the same general direction as the lever.

17. The combination recited in claim 16 in which the latch is rendered effective by the float in response to rising water level.

18. The combination recited in claim 16 in which the latch is rendered effective by movement of the flush lever to flushing position.

19. In a water saver attaching to a toilet flush tank having an outlet, an overflow pipe means, a flapper-float type valve for the outlet mounted on pivots on the overflow pipe means and an externally operated flush lever for opening the flapper valve, the combination of, an elongated base member constructed with a curved surface fitting over the overflow pipe means in a fixed location, clamping means for the base member for clamping the overflow pipe means in said fixed location, operator means mounted on said base member and arranged to operate the flapper valve, said operator means being biased with sufficient force to move the flapper valve to closed position, restraining means also mounted on said base member and associated with the operator means for holding the latter in a position allowing movement of the flapper valve to open position, means for moving the operator means to restrained position, and float means mounted on said base member arranged to release the restraining means when the water level drops to a predetermined water saving level.

* * * * *